US006749470B2

(12) United States Patent
Dangelmaier

(10) Patent No.: US 6,749,470 B2
(45) Date of Patent: Jun. 15, 2004

(54) CONNECTOR

(75) Inventor: Markus Dangelmaier, Aalen (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/370,383

(22) Filed: Feb. 19, 2003

(65) Prior Publication Data

US 2003/0176112 A1 Sep. 18, 2003

(30) Foreign Application Priority Data

Feb. 19, 2002 (EP) ..... 02003763

(51) Int. Cl.[7] ..... H01R 13/00
(52) U.S. Cl. ..... 439/857; 439/924.1
(58) Field of Search ..... 439/857, 856, 439/884, 660, 682, 692, 924.1

(56) References Cited

U.S. PATENT DOCUMENTS

| | | | | | |
|---|---|---|---|---|---|
| 4,679,890 | A | | 7/1987 | Fineblum | 439/884 |
| 4,734,041 | A | * | 3/1988 | Bruchmann et al. | 439/637 |
| 4,900,278 | A | | 2/1990 | Yamada et al. | 439/857 |
| 5,083,944 | A | * | 1/1992 | Self, Jr. | 439/595 |
| 5,478,259 | A | * | 12/1995 | Noschese | 439/607 |
| 6,299,492 | B1 | * | 10/2001 | Pierini et al. | 439/884 |

* cited by examiner

*Primary Examiner*—Hien Vu

(57) ABSTRACT

A low insertion force connector that has a female socket and a male plug. The female socket has a contact element with first and second adjacent contact blades. The male plug has a pin terminal with a first side and a second side. The first side has a first receiving zone adjacent to a second receiving zone. The first receiving zone is offset from the second receiving zone such that deflection of the first contact blade by the first receiving zone differs from the deflection of the second contact blade by the second receiving zone when the pin terminal is mated with the contact element.

25 Claims, 2 Drawing Sheets

CONNECTOR

BACKGROUND OF THE INVENTION

The invention relates to a connector and, more particularly, to a low insertion force connector having a female socket and a male plug with a pin terminal.

DESCRIPTION OF THE PRIOR ART

To reduce the insertion force of a male plug in a female socket in conventional connectors, the male plug is provided with a pin terminal having a flat or rounded tip. For example, U.S. Pat. No. 4,679,890 discloses a pin terminal with a tip wherein two mutually opposing sides of the tip have a curved surface. One side of the tip has a curved surface with a smaller radius than an opposite side of the tip. Upon insertion of the pin terminal into a female socket having opposing contact blades, the contact blades are sequentially deflected to different degrees as a function of the insertion depth of the tip to reduce the overall insertion force. In addition, U.S. Pat. No. 4,900,278 discloses a male plug with a pin terminal having a tip wherein two mutually opposing sides of the tip have slanted surfaces extending downward at a similar angle. The slanted surfaces are asymmetrical with respect to a center axis of the pin terminal so that the insertion force of the pin terminal is a function of insertion depth.

SUMMARY OF THE INVENTION

It is an object of the invention to provide a connector that despite a simple construction and ease of handling exhibits a favourable low insertion force. This and other objects are achieved by a low insertion force connector having a female socket and a male plug. The female socket has a contact element with first and second adjacent contact blades. The male plug has a pin terminal with a first side and a second side. The first side has a first receiving zone adjacent to a second receiving zone. The first receiving zone is offset from the second receiving zone such that deflection of the first contact blade by the first receiving zone differs from the deflection of the second contact blade by the second receiving zone when the pin terminal is mated with the contact element.

DETAILED DESCRIPTION OF THE PREFERRED EMBODIMENT

Figure 1:
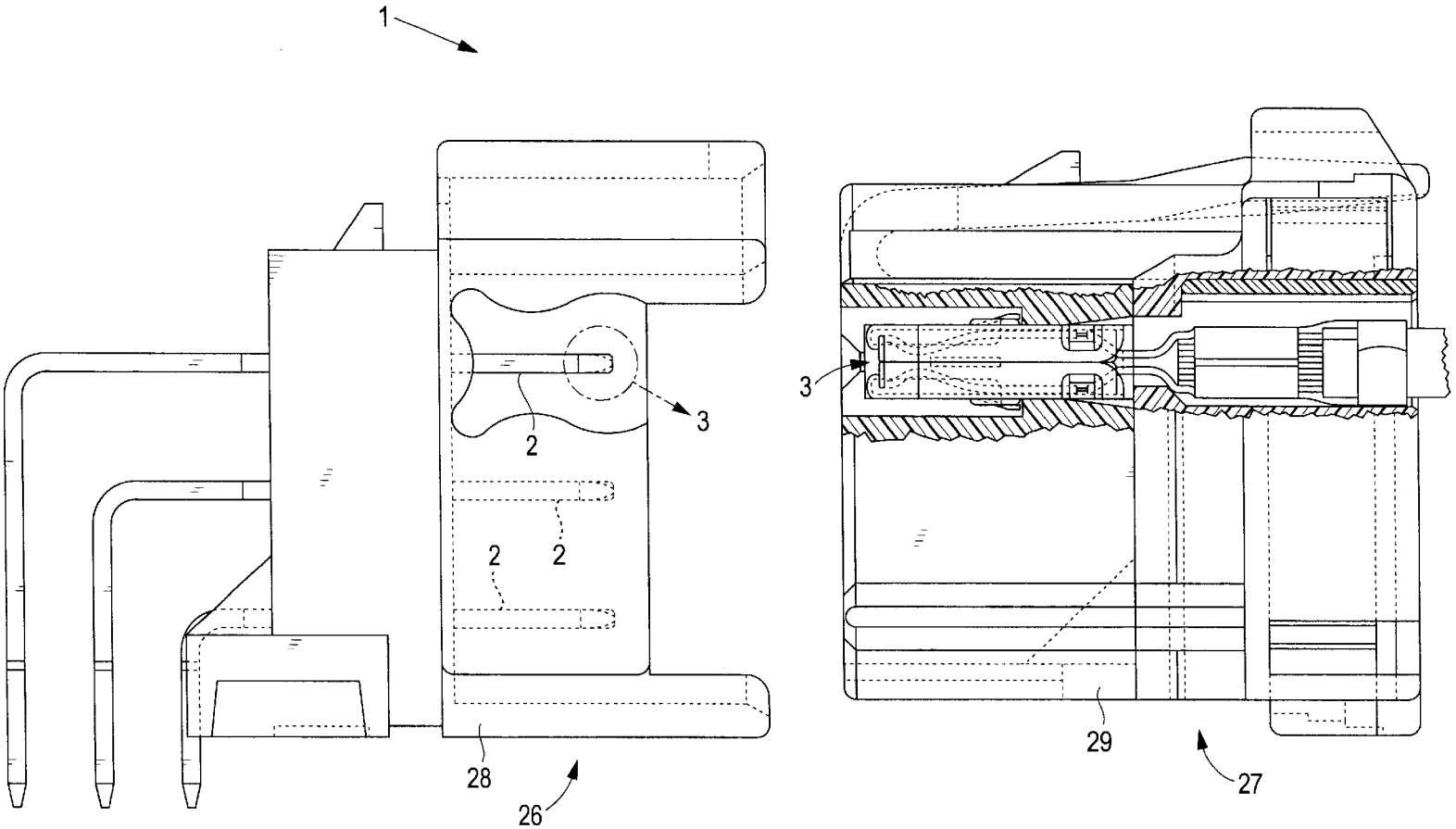
FIG. 1 is a plan view of a male plug and female socket of a connector according to the invention.

FIG. 1 shows a connector 1 having a male plug 26 and a corresponding female socket 27. The male plug 26 has a plug housing 28 provided with pin terminals 2. The female socket 27 has a socket housing 29 provided with contact elements 3 that correspond to the pin terminals 2. For simplicity, only one of the contact elements 3 is illustrated.

Figure 2:
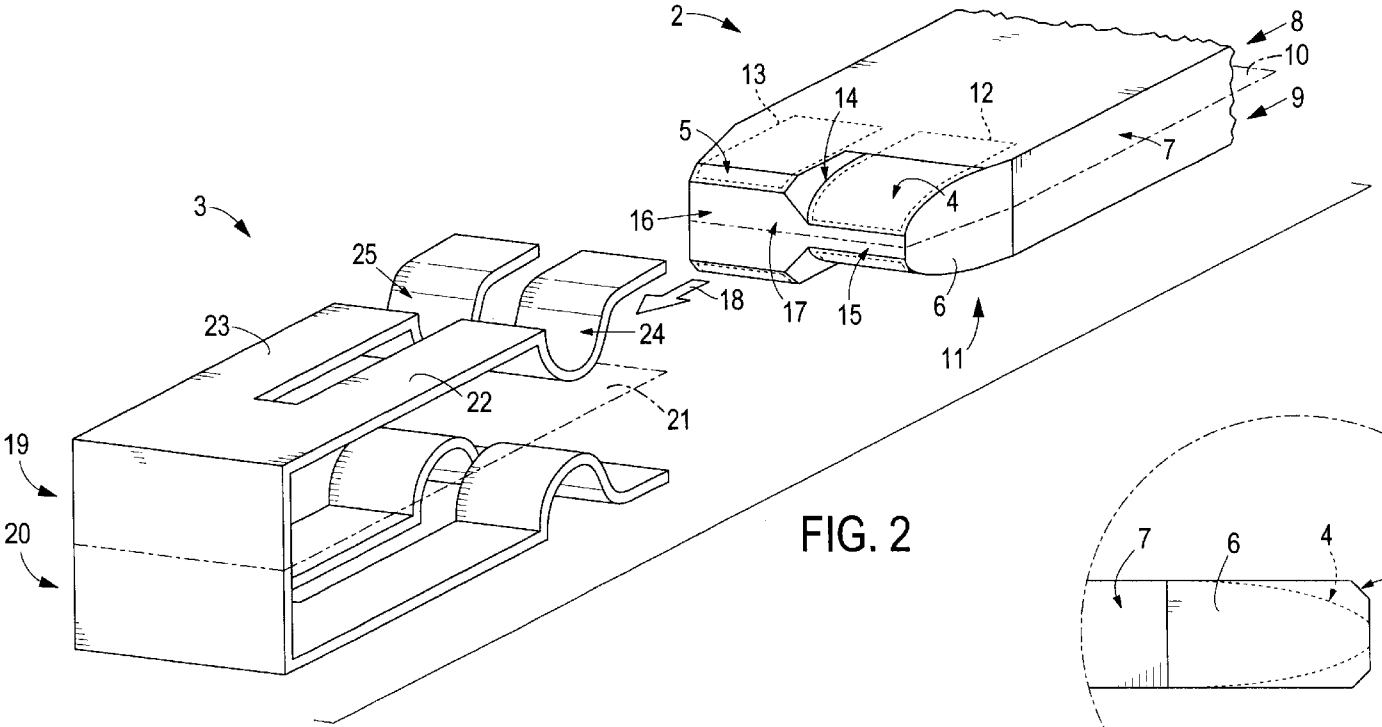
FIG. 2 is a perspective view of a contact element of the female socket and a pin terminal of the male plug of FIG. 1.

The pin terminal 2 will now be described in greater detail. As shown in FIG. 2, the pin terminal 2 has a first side 8 and a second side 9. The first side 8 is substantially symmetrical to the second side 9 along a plane 10 of the pin terminal 2.

The plane 10 is oriented substantially parallel to an insertion direction 18. Because the first side 8 and the second side 9 are symmetrical relative to the plane 10, only the first side 8 will be described in greater detail herein with the understanding that the second side 9 has substantially the same configuration.

The first side 8 has adjacent first and second receiving zones 12, 13 arranged on a front surface 11 of the pin terminal 2 and separated by a groove 14. The groove 14 may serve as a guide element for insertion of the male plug 26 into the female socket 27. As shown most clearly in FIG. 3, the first receiving zone 12 is offset relative to the second receiving zone 13 transversely to the insertion direction 18. The first receiving zone 12 has a first profile face 4. The first profile face 4 has a curved configuration. The second receiving zone 13 has a second profile face 5. The second profile face 5 has a substantially flat configuration. The second profile face 5 is steeper than the first profile face 4.

A first front face 15 adjoins the first receiving zone 12. A second front face 16 adjoins the second receiving zone 13 and has a height larger than the height of the first front face 15. A third front face 17 adjoins the groove 14 and adjoins the first front face 15 with the second front face 16. The first, second, and third front faces 15, 16, 17 lie in substantially the same plane and are substantially perpendicular to the insertion direction 18. The first, second, and third front faces 15, 16, 17 terminate the pin terminal 2 allowing 2 the pin terminal 2 to be made shorter, reducing materials and simplify shaping.

Figure 3:
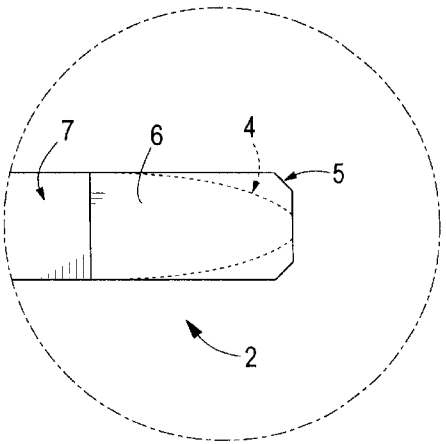
FIG. 3 is a magnified view of the pin terminal of FIG. 1.

As shown in FIGS. 2 and 3, the first side 8 has a first end face 7 and a second end face (not shown). The first end face 7 has an inclined front surface 6 that adjoins the first profile face 4 and the first front face 15 at an angle. The second end face (not shown) has an inclined front surface (not shown) that adjoins the second profile face 5 and the second front face 16 at an angle. The inclined front surfaces 6 are configured such that the width of the front surface 11 of the pin terminal 2 is smaller than the width of the rest of the pin terminal 2 to simplify insertion of the pin terminal 2 into the female socket 27.

The contact element 3 will now be described in greater detail. As shown in FIG. 2, the contact element 3 has a first contact part 19 and a second contact part 20. The first contact part 19 is substantially symmetrical to the second contact part 20 along a longitudinal axis 21 of the contact element 3. The longitudinal axis 21 is oriented substantially parallel to the insertion direction 18. Because the first contact part 19 and the second contact part 20 are symmetrical relative to the longitudinal axis 21, only the first contact part 19 will be described in greater detail herein with the understanding that the second contact part 20 has substantially the same configuration.

The first contact part 19 has adjacent first and second contact blades 22, 23. The first and second contact blades 22, 23 may be connected at a base so that the contact element 3 may be made from one piece to greatly simplify manufacturing, storage, and positioning of the contact element within the female socket 27. The first and second contact blades 22, 23 have arcuate portions 24, 25, respectively. The arcuate portions 24, 25 have contact portions that correspond with the first and second receiving zones 12, 13 of the first side 8. The first contact element 22 is associated with the first receiving zone 12, and the second contact element 23 is associated with the second receiving zone 13.

Insertion of the pin terminal 2 into the contact element 3 will now be described in greater detail with reference to the first side 8 and the first contact part 19. Because the second side 9 and the second contact part 20 are substantially symmetrical to the first side 8 and the first contact part 19, respectively, only the insertion of the first side 8 into the first contact part 19 will be described in greater detail with the understanding that the second side 9 is received in the second contact part 20 in substantially the same manner.

The pin terminal 2 is inserted in the insertion direction 18 between the first contact part 19 and the second contact part 20. The first and second receiving zones 12, 13 are received adjacent to the first and second contact blades 23, 24 of the contact element 3, respectively. As the pin terminal 2 is advanced, the second receiving zone 13 contacts the second arcuate portion 25 to cause the second contact blade 23 to deflect. As the pin terminal 2 is further advanced, the first receiving zone 12 contacts the first arcuate portion 24 causing the first contact blade 22 to deflect. The groove 14 ensures that the first and second contact blades 22, 23 deflect independently of each other as a function of the insertion depth of the pin terminal 2. When the pin terminal 2 is fully received within the contact element 3, the pin terminal 2 is firmly held by the two mutually adjacent first and second contact blades 22, 23 to help withstand vibration.

Since the first receiving zone 12 is offset relative to the second receiving zone 13 transversely to the insertion direction 18, the second arcuate portion 25 contacts the second receiving zone 13 before the first arcuate portion 24 contacts the first receiving zone 12. Because the second contact blade 23 is caused to deflect before the first contact blade 22, the sum of the insertion force slowly increases as the pin terminal 2 is received in the contact element 3. Thus, the male plug 26 is easier to insert into the female socket 27 at the beginning of insertion therein. Further, deflection of the second contact blade 23 occurs more quickly and with more force with regard to the insertion depth of the pin terminal 2 than deflection of the first contact blade 22, since the second profile face 5 begins higher with regard to the plane 10 and extends more steeply than the first profile face 4.

It is possible to maintain a normal contact force by using the mutually adjacent first and second contact blades 22, 23 that have little influence on one another during deflection and the separate first and second receiving zones 12, 13 that have a decisive form for the force required for deflecting the respective contact blades 22, 23. At least one of the receiving zones 13 may be steeper in the insertion direction 18 than the other receiving zone 12 to produce a different insertion force for each of the receiving zones 12, 13 as a function of the insertion depth of the pin terminal 2. The increase in the insertion force is distributed over the insertion depth and the sum of the insertion force is determined as a function of the incline. Further, because one receiving zone 12 has a curved profile face 4, development of the insertion force as a function of insertion depth is achieved beyond the possibilities offered by flat receiving zones.

Because the height of the first and second front faces 15, 16 differ, the length of the receiving zones 12, 13 may be individually tailored to the height of the respective contact blades 22, 23. When the front faces of two adjacent receiving zones lie in the same plane, the shaping of the front surface 11 of the pin terminal 3 is simplified. Because at least two of the receiving zones 12, 13 are arranged on the first side 8 and corresponding receiving zones are arranged on the second side 9, the contact reliability and contact quality of the connector 1 is increased by the larger number of contact elements 22, 23 contacting the pin terminal.

The foregoing illustrates some of the possibilities for practicing the invention. Many other embodiments are possible within the scope and spirit of the invention. For example, at least one arcuate portion 24, 25 may be offset along the insertion direction 18 and/or offset transversely to the insertion direction 18 relative to the other arcuate portion 4, 25 to further influence the insertion force as a function of insertion depth. It is, therefore, intended that the foregoing description be regarded as illustrative rather than limiting, and that the scope of the invention is given by the appended claims together with their full range of equivalents.

I claim:

1. A low insertion force connector comprising:

a female socket having a contact element with first and second laterally adjacent contact blades; and a male plug having a pin terminal, the pin terminal having a first side and a second side, the first side having a first receiving zone laterally adjacent to a second receiving zone, the first receiving zone and the second receiving zone having different shapes such that deflection of the first contact blade by the first receiving zone differs from the deflection of the second contact blade by the second receiving zone during mating of the pin terminal with the contact element.

2. The connector of claim 1, wherein the second receiving zone has an inclined surface.

3. The connector of claim 1, wherein the first receiving zone has a curved surface.

4. The connector of claim 1, further comprising a groove that separates the first receiving zone from the second receiving zone.

5. The connector of claim 4, wherein the groove is formed as a guide element for insertion of the pin terminal into the contact element.

6. The connector of claim 1, wherein the pin terminal has a front surface that is received in the contact element, the height of the front surface adjoining the second receiving zone is greater than the height of the front surface adjoining the first receiving zone.

7. The connector of claim 6, wherein the front surface of the first receiving zone and the front surface of the second receiving zone lie in a single plane.

8. The connector of claim 1, wherein the second side of the pin terminal is symmetrical to the first side.

9. The connector of claim 1, wherein the first contact blade includes a first arcuate portion and the second contact blade includes a second arcuate portion, the first arcuate portion is offset relative to the second arcuate portion.

10. The connector of claim 1, wherein the first receiving zone is offset from the second receiving zone in a direction transverse to a direction of insertion of the pin terminal into the contact element.

11. The connector of claim 1, wherein the first receiving zone is offset from the second receiving zone in a direction parallel to a direction of insertion of the pin terminal into the contact element.

12. The connector of claim 1, wherein the pin terminal has an angled edge adjacent to the first and second receiving zones that reduces the width of the pin terminal about the first and second receiving zones.

13. The connector of claim 1, wherein the first and second contact blades are joined at a base.

14. A low insertion force connector comprising:

a female socket having a contact element with first and second adjacent contact blades; and a male plug having a pin terminal, the pin terminal having a first side and a second side, the first side having a first receiving zone adjacent to a second receiving zone, the second receiving zone having an inclined surface and the first receiving zone having a curved surface such that deflection of the first contact blade by the first receiving zone differs from the deflection of the second contact blade by the second receiving zone when the pin terminal is mated with the contact element.

15. The connector of claim 14, wherein the inclined surface is steeper than the curved surface.

16. The connector of claim 14, further comprising a groove that separates the first receiving zone from the second receiving zone.

17. The connector of claim 16, wherein the groove is formed as a guide element for insertion of the pin terminal into the contact element.

18. The connector of claim 14, wherein the pin terminal has a front surface that is received in the contact element, the height of the front surface adjoining the second receiving zone is greater than the height of the front surface adjoining the first receiving zone.

19. The connector of claim 18, wherein the front surface of the first receiving zone and the front surface of the second receiving zone lie in a single plane.

20. The connector of claim 14, wherein the second side of the pin terminal is symmetrical to the first side.

21. The connector of claim 14, wherein the first contact blade includes a first arcuate portion and the second contact blade includes a second arcuate portion, the first arcuate portion is offset relative to the second arcuate portion.

22. The connector of claim 14, wherein the first receiving zone is offset from the second receiving zone in a direction transverse to a direction of insertion of the pin terminal into the contact element.

23. The connector of claim 14, wherein the first receiving zone is offset from the second receiving zone in a direction parallel to a direction of insertion of the pin terminal into the contact element.

24. The connector of claim 14, wherein the pin terminal has an angled edge adjacent to the first and second receiving zones that reduces the width of the pin terminal about the first and second receiving zones.

25. The connector of claim 14, wherein the first and second contact blades are joined at a base.

* * * * *